US010577228B2

(12) United States Patent
Verchere et al.

(10) Patent No.: US 10,577,228 B2
(45) Date of Patent: Mar. 3, 2020

(54) AUTOMATIC UNFOLDING AND FOLDING TOWER CRANE COMPRISING A MAST AND A JIB SHIFTED WITH RESPECT TO THE MAST

(71) Applicant: MANITOWOC CRANE GROUP FRANCE, Dardilly (FR)

(72) Inventors: Jean-Paul Verchere, St Nizier sous Charlieu (FR); Poerio Betti, Mondovi (IT); Olivier Gevaudant, Marcy L'Etoile (FR); Fabrice Thomas, Lyons (FR)

(73) Assignee: MANITOWOC CRANE GROUP FRANCE, Dardilly (FR)

( * ) Notice: Subject to any disclaimer, the term of this patent is extended or adjusted under 35 U.S.C. 154(b) by 394 days.

(21) Appl. No.: 15/389,933

(22) Filed: Dec. 23, 2016

(65) Prior Publication Data

US 2017/0183203 A1 Jun. 29, 2017

(30) Foreign Application Priority Data

Dec. 23, 2015 (FR) ..... 15 63220

(51) Int. Cl.

| | |
|---|---|
| ***B66C 23/06*** | (2006.01) |
| ***B66C 23/68*** | (2006.01) |
| ***B66C 23/70*** | (2006.01) |
| ***B66C 23/74*** | (2006.01) |

(52) U.S. Cl.

CPC ..... *B66C 23/68* (2013.01); *B66C 23/06* (2013.01); *B66C 23/702* (2013.01); *B66C 23/74* (2013.01)

(58) Field of Classification Search

CPC ..... B66C 23/06; B66C 23/342; B66C 23/344; B66C 23/66; B66C 23/68; B66C 23/74; B66C 23/78

See application file for complete search history.

(56) References Cited

U.S. PATENT DOCUMENTS

| | | | | |
|---|---|---|---|---|
| 3,361,268 A * | 1/1968 | Pingon | B66C 23/344 212/197 |
| 3,638,805 A * | 2/1972 | Garnier | B66C 23/62 180/9.52 |
| 5,140,929 A | 8/1992 | Gaspard | |

(Continued)

FOREIGN PATENT DOCUMENTS

| | | |
|---|---|---|
| EP | 04373518 A1 | 3/1992 |
| EP | 0855361 A1 | 7/1998 |

(Continued)

*Primary Examiner* — Emmanuel M Marcelo

(74) *Attorney, Agent, or Firm* — Cantor Colburn LLP

(57) ABSTRACT

This automatic unfolding and folding tower crane comprises a mast and a jib which are movable between an operation configuration and a transport configuration.

The mast has a first mast section (2.1) and a second mast section (2.2). The jib has a first jib section (4.1) and a second (4.2) jib section. The first jib section (4.1) has an upper limit (4.11) and a lower limit (4.12) defining a height (H4.1) of the first jib section (4.1). The first mast section (2.1) is rotatably connected to the first jib section (4.1) about a hinge axis (Y24).

The jib direction (X4) is shifted with respect to the mast direction (Z2) parallel to the hinge axis (Y24). A distance between the hinge axis (Y24) and the lower limit (4.12) is greater than 75% of the height (H4.1) of the first jib section (4.1).

14 Claims, 5 Drawing Sheets

(56) References Cited

U.S. PATENT DOCUMENTS

| | | | | |
|---|---|---|---|---|
| 6,290,078 | B1 * | 9/2001 | Verchere | B66C 23/26 212/300 |
| 2008/0169258 | A1 * | 7/2008 | Weisbauer | B66C 23/185 212/296 |
| 2014/0131300 | A1 | 5/2014 | Scampini et al. | |

FOREIGN PATENT DOCUMENTS

| | | | | |
|---|---|---|---|---|
| FR | 2104681 | A1 | 4/1972 | |
| GB | 1247658 | A * | 9/1971 | B66C 9/14 |

* cited by examiner

Fig. 1
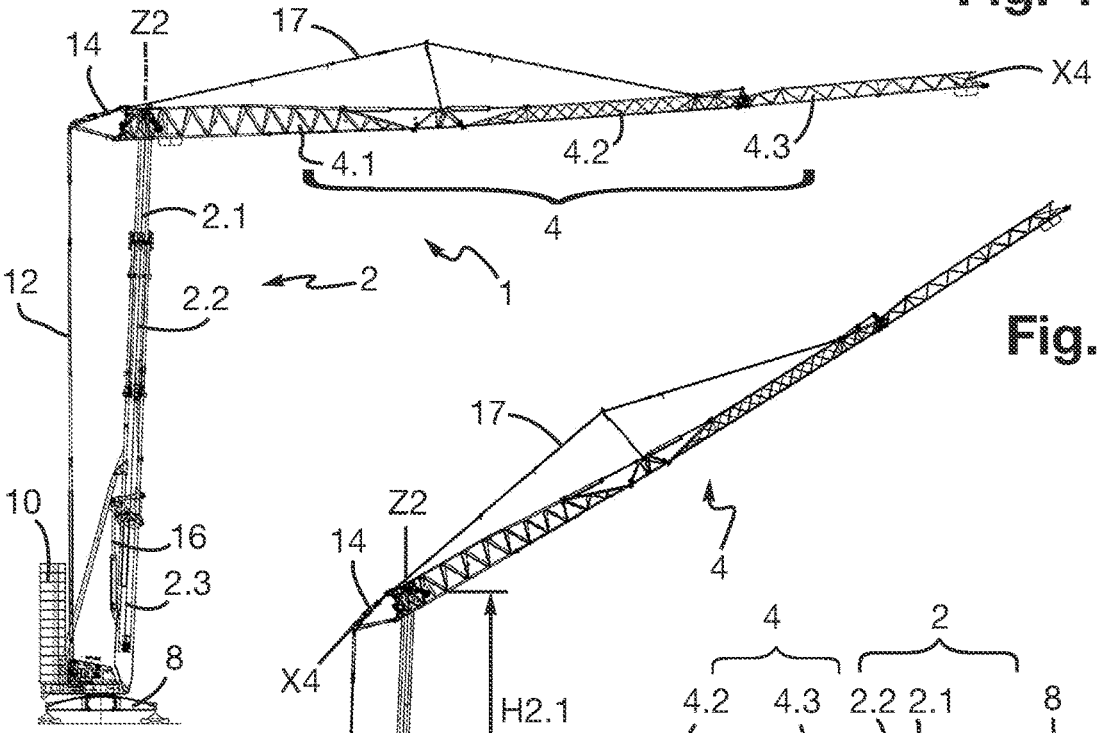
Fig. 2
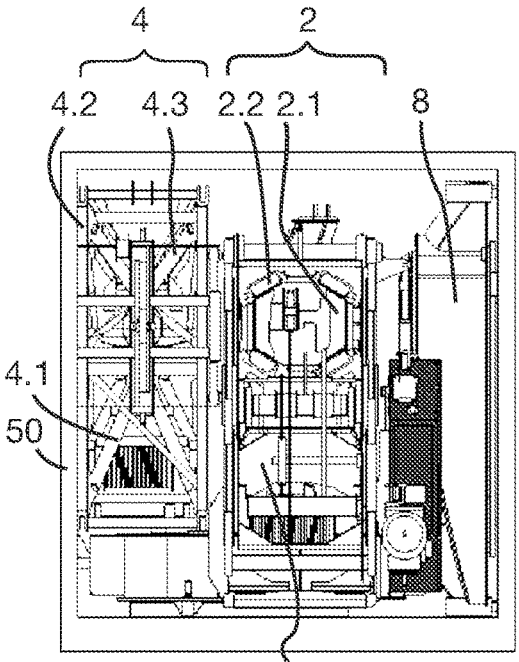
Fig. 4
Fig. 3
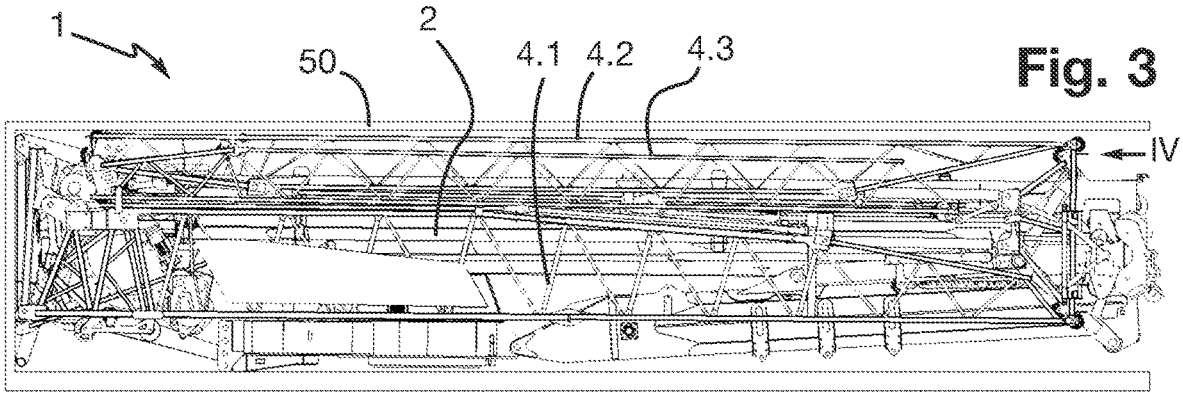

AUTOMATIC UNFOLDING AND FOLDING TOWER CRANE COMPRISING A MAST AND A JIB SHIFTED WITH RESPECT TO THE MAST

CROSS REFERENCE TO RELATED APPLICATION

This application is related to and claims the benefit of French Patent Application Number 15/63220 filed on Dec. 23, 2015, the contents of which are incorporated herein by reference in their entirety.

TECHNICAL FIELD

The present invention concerns an automatic unfolding and folding tower crane. The present invention applies to the field of tower cranes having a mast and a jib, for example distributing jib cranes or luffing jib cranes.

BACKGROUND

EP0855361A1 describes an automatic unfolding and folding tower crane, comprising a mast and a jib which are movable between an operation configuration (vertical mast and horizontal jib) and a transport configuration (folded mast and jib). The mast has several mast sections and a second mast section and the jib has several jib sections. A first mast section is rotatably connected to the first jib section about a hinge axis which is orthogonal to the direction of the mast and to the direction of the jib when the tower crane is in the operation configuration.

However, such a tower crane is relatively bulky in the transport configuration, in particular in height, because this tower crane requires superimposing the jib sections.

BRIEF SUMMARY

The present invention aims in particular to solve all or part of the aforementioned problems.

To this end, an automatic unfolding and folding tower crane is disclosed, comprising a mast and a jib configured to be placed at least:

in an operation configuration, in which the mast extends along a mast direction which is substantially vertical, and the jib extends along a jib direction which is substantially horizontal, and in a transport configuration in which the mast and the jib are folded, the mast having at least: one first mast section and one second mast section which extend substantially along the mast direction when the tower crane is in the operation configuration, the jib having at least: one first jib section and one second jib section which extend substantially along the jib direction when the tower crane is in the operation configuration, the first jib section having, at the level of the mast, an upper limit and a lower limit, the upper limit and the lower limit defining a height of the first jib section, the first mast section being connected to the first jib section at least in rotation about a hinge axis, the hinge axis extending orthogonally to the mast direction and to the jib direction when the tower crane is in the operation configuration, the tower crane being characterized:

in that the jib direction is shifted with respect to the mast direction parallel to the hinge axis, in that a distance between the hinge axis and the lower limit, measured parallel to the mast direction, is greater than 75%, preferably greater than 90%, of said height of the first jib section.

In other words, the hinge axis extends in an upper region of the first jib section.

Thus, the tower crane may be stowed in a standardized freight container (40-feet long, about 12.20 m), while offering a height, in the operation configuration, greater than a self-erecting tower crane with an equivalent capacity. Typically, the gain in height of a tower crane in accordance with the invention in the operation configuration may be 5 m, namely about +20%.

The shift (or offset) of the jib with respect to the mast and the top location of the hinge axis allow the tower crane to have optimum dimensions in the transport configuration, without changing the maximum width of the convoy determined by the width of the axle of the vehicle. Indeed, this shift allows superimposing two rows of folded jib sections.

Since the jib direction is shifted with respect to the mast direction parallel to the hinge axis, the jib direction and the mast direction are separate, and therefore non-intersecting, directions. In addition, when the tower crane is in the operation configuration, a lateral portion of the first jib section extends along a lateral portion of the first mast section.

When the tower crane is in the operation configuration on a horizontal ground, the mast direction can form an angle comprised between 0 degrees and 3 degrees with a vertical direction. When the tower crane is in the operation configuration, the jib direction can form an angle comprised between 0 degrees and 45 degrees with a horizontal direction.

According to one variant, the jib direction is orthogonal to the mast direction when the tower crane is in the operation configuration, and the jib direction is substantially parallel to the mast direction when the tower crane is in the transport configuration.

According to one variant, the first mast section has a polygonal shaped cross-section with at least eight sides, and the second mast section has a polygonal shaped cross-section with at least eight sides.

According to one variant, the first mast section has a generally prismatic shape composed of flat metal sheets, and the second mast section has a generally prismatic shape composed of flat metal sheets.

According to one embodiment, the first jib section comprises at least: i) one upper chord defining the upper limit and ii) one lower chord defining the lower limit.

According to one variant, the first jib section comprises two upper chords and two lower chords arranged so that the first jib section has a generally trapezoidal section transversely to the jib direction. In other words, the jib foot comprises four chords. Thus, the jib foot has a very high resistance to the lateral forces, while reducing the bulk required for the tubes forming the upper chords.

Alternatively to this variant, the first jib section comprises, over the majority of its length, one single upper chord and two lower chords arranged so that the first jib section has a generally triangular shape in cross-section relative to the jib direction, nevertheless with a trapezoidal section for housing the hinge bearings between the jib and the mast.

Still alternatively, the first jib section has a box structure and/or the second jib section has a box structure.

According to one variant, the tower crane further comprises a hinge device configured to link the first mast section to the first jib section at least in rotation about the hinge axis.

The hinge device may comprise rotary bearings. The hinge device is sized, in particular in stiffness, so as to mechanically resist the moments generated on the mast by the position of the jib in operation.

According to one variant, the first jib section comprises a jib hinge portion, the first mast section comprises a mast hinge portion, the jib hinge portion and the mast hinge portion being connected by the hinge device.

The mast hinge portion is located close to the upper limit of the mast when the tower crane is in the operation configuration. According to one variant, the distance between the mast hinge portion and the upper limit of the mast is smaller than 5% of the height of the first mast section, measured parallel to the mast direction when the tower crane is in the operation configuration.

The jib hinge portion is located close to the rear end of the jib when the tower crane is in the operation configuration. According to one variant, the distance between the jib hinge portion (hinge axis) and the rear end of the jib (end of the king-rod) is smaller than 20% of the length of the first jib section, measured parallel to the jib direction when the tower crane is in the operation configuration.

According to one embodiment, the jib direction is shifted with respect to the mast direction so that a shift distance between i) a lateral portion of the jib turned toward the mast and ii) a lateral portion of the mast turned toward the jib, measured parallel to the hinge axis, is greater than 200 mm, preferably greater than 250 mm.

Thus, unlike the tower cranes of the state of the art, the width of the jib does not depend on the width of the mast. Hence, the jib may have an enlarged first jib section, which enhances its mechanical resistance to the forces that the jib transmits to the mast.

According to one variant, a shift distance between the jib direction and the mast direction, measured parallel to the hinge axis, is comprised between 900 mm and 1100 mm.

According to one embodiment, the first mast section and the second mast section are configured so that the first mast section can slide inside the second mast section.

In other words, the mast comprises at least one telescopic portion. In the operation configuration, the first mast section extends substantially above the second mast section; in the transport configuration, the first mast section extends substantially inside the second mast section.

Thus, such a telescopic mast not only allows having a very compact tower crane in the transport configuration and a very high working height, but it also allows lifting the jib simultaneously with the telescoping of the mast.

According to one embodiment, said height of the first jib section is greater than the width of the first jib section, measured parallel to the hinge axis.

In other words, the cross-section of the jib is rectangular or trapezoidal. When the tower crane is in the operation configuration, the long side of this cross-section is vertical.

According to one variant, the height of the first jib section is greater than 800 mm, for example approximately equal to 1000 mm. Thus, such a height allows the first jib section to mechanically resist the forces that the jib transmits to the mast.

According to one variant, the height of the first jib section is greater than the height of the second jib section.

According to one embodiment, the tower crane further comprises:

- a frame configured to support the mast and the jib when the tower crane is in the operation configuration, the frame being intended to receive a counterweight,
- a retaining tie-rod arranged to connect the rear end of the jib to the counterweight, the retaining tie-rod being configured to extend substantially parallel to the mast when the tower crane is in the operation configuration, and
- a force transmitting member arranged to transmit forces from the jib to the retaining tie-rod, the transmission member being constituted by a king-rod extending obliquely with respect to the jib direction.

Thus, such a retaining tie-rod allows compensating the cantilever effects induced by the jib on the mast.

Since the tower crane comprises a horizontal king-rod, the jib is devoid of a vertical king-rod for supporting the first jib section, which simplifies the mounting of the tower crane. In other words, the first jib section is <<topless>>, because the tower crane has no king-rod located above the mast. Thanks to its trapezoidal shape, the structure of the first jib section is sufficient to mechanically resist the forces generated by the dead weights and by the load hanging from the jib.

According to one variant, the retaining tie-rod is composed of bars hinged together. The raising angle of the jib is managed before the unfolding by an operator positioning manually a lock serving as a stop between a male tie-rod and a female tie-rod which perform the retaining function. Alternatively to this variant, the retaining tie-rod may comprise a cable portion.

Alternatively to the previous embodiment, the tower crane may comprise:

- a frame configured to support the mast and the jib when the tower crane is in the operation configuration, the frame being intended to receive a counterweight, and
- a hydraulic retaining cylinder arranged to drive the jib in rotation about the hinge axis.

In this alternative, the retaining cylinder replaces a portion of the retaining tie-rod. The retaining cylinder may be hydraulic. Thus, such a retaining cylinder allows the construction of economical tower cranes, because the retaining cylinder resumes the moment forward, which allows having a low-capacity telescoping mechanism, which is sized only for telescoping dead weights (unloaded mast and jib) but not for lifting the jib.

According to another alternative to this variant, the jib is mechanically connected to the base exclusively by the telescopic mast, the width of the cross-section of the telescopic mast being smaller than 70% of the length of the cross-section of the telescopic mast.

According to one variant, the tower crane comprises a winch and a reeving system arranged to transmit a lifting force to the jib. This winch and this reeving system then replace a portion of the retaining tie-rod.

According to one variant, the tower crane further comprises an intermediate king-rod arranged above the junction between the first and second jib sections. Thus, such an intermediate king-rod allows reducing the dead weight of the second jib section, which reduces the moments induced on the mast by the shifted position of the jib.

According to one embodiment, the king-rod comprises a guide element which is configured to guide the retaining tie-rod, the guide element being located on the side opposite to the jib direction with respect to the mast direction.

In other words, the guide element and the jib direction are located on either side of the mast direction. Thus, the king-rod extends according to an oblique direction with respect to the jib direction, which allows the king-rod to transmit effectively the vertical forces from the jib to the mast.

According to one embodiment, a distance between the guide element of the king-rod and the mast direction, measured parallel to the hinge axis, is comprised between 75 mm and 150 mm.

Thus, such a distance allows the retaining tie-rod to transmit effectively the forces from the jib to the mast without having a significant angle between the direction of the retaining tie-rod and the mast direction for each working angle, which avoids generating parasitic horizontal forces.

According to one embodiment, the retaining tie-rod extends substantially on the side opposite to the jib direction with respect to the mast direction, the tower crane further comprising an unfolding cylinder configured to unfold the mast, in order to place the mast and the jib in the operation configuration, the unfolding cylinder being arranged on the same side of the mast direction as the first jib section.

In other words, the retaining tie-rod and the unfolding cylinder extend on either side of the mast direction, because the retaining tie-rod extends on one side of the jib direction and the unfolding cylinder extends on the other side of the jib direction.

Thus, the retaining tie-rod limits the lateral cantilever effect of the jib on the mast, because the retaining tie-rod is shifted on the side opposite to the jib direction. Since the unfolding cylinder is located on the side of the jib, the unfolding cylinder is close to the overall center of gravity of the masses to be lifted. Since the retaining tie-rod and the unfolding cylinder are located on opposite sides, the tower crane is particularly compact in the transport configuration.

According to one embodiment, the king-rod and a lower portion of the first jib section are rotatably linked about an axis of rotation which is parallel to the hinge axis, the tower crane further comprising connecting rods and a universal joint arranged to connect the king-rod to an upper portion of the first jib section, the connecting rods being hinged together by pivot linkages and by the universal joint.

Thus, the king-rod, on which the retaining tie-rod is linked, can be folded in a stowed position, in which the king-rod extends both opposite the first jib section and opposite the first mast section, which is particularly compact. Indeed, the universal joint and the axis of rotation allow folding the king-rod according to separate pivot axes.

According to one embodiment, the tower crane further comprises a hoisting cable and several pulleys configured to guide the hoisting cable between the first mast section and the first jib section, the axes of the pulleys being non-parallel, the pulleys being arranged so that two consecutive pulleys along the hoisting cable have two collinear tangential directions.

In other words, the tracks of two consecutive pulleys are aligned. Thus, the hoisting cable will have a greater resistance to wear and to fatigue, because the pulleys tracks are aligned in pairs, which removes any deflection angle of the hoisting cable between two consecutive pulleys. The pulleys allow transmitting the movement of the hoisting cable extending from a hoisting winch mounted on the frame or to the foot of the mast up to a carriage mounted on the jib.

According to one embodiment, when the tower crane is in the transport configuration, the first and the second jib sections are superimposed and disposed next to the mast.

According to one variant, the tower crane comprises a third jib section which is mechanically connected to the second jib section and which is superimposed to the first and second jib sections when the tower crane is in the transport configuration.

The aforementioned embodiments and variants may be considered separately or according to any technically possible combination.

BRIEF DESCRIPTION OF THE DRAWINGS

The present invention will be better understood and its advantages will also emerge in the light of the following description, given only as a non-limiting example and made with reference to the appended figures, in which identical reference indications correspond to structurally and/or functionally identical or similar elements. In the appended figures:

FIG. 1 is a side view of a tower crane in accordance with the invention and comprising a mast and a jib, in the operation configuration;

FIG. 2 is a side view of the tower crane of FIG. 1 in the operation configuration, in a lifted position;

FIG. 3 is a side view of the tower crane of FIG. 1 in the transport configuration in a container;

FIG. 4 is a front view, according to the arrow IV, in FIG. 3;

DETAILED DESCRIPTION

Figure 5:
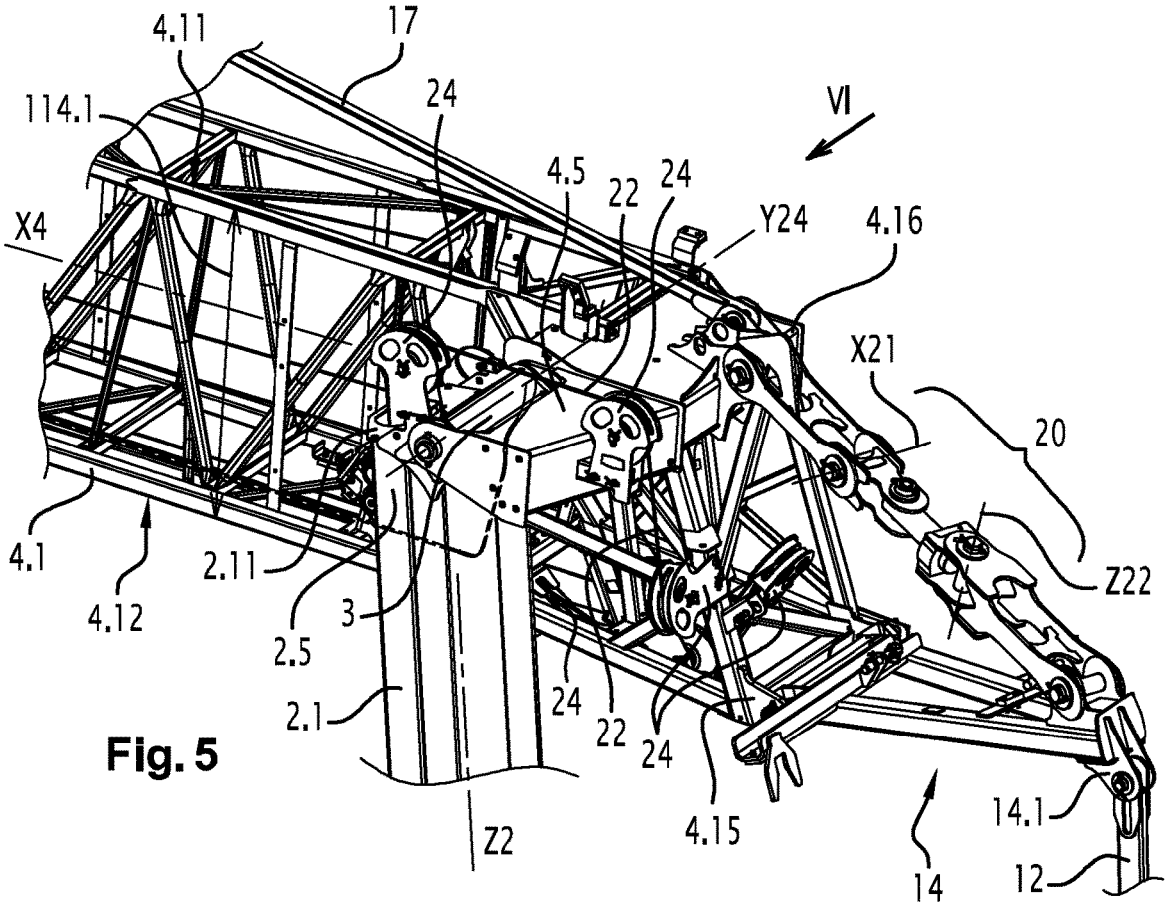
FIG. 5 is a perspective view of a rear portion of the tower crane of FIG. 1.

FIGS. 1, 2, 3, 4, 5, 6, 7 and 8 illustrate an automatic unfolding and folding tower crane 1. The tower crane 1 comprises a mast 2 and a jib 4 configured to be placed:

- in an operation configuration (or working configuration), in which the mast 2 extends along a mast direction Z2 which is substantially vertical, and the jib 4 extends along a jib direction X4 which is substantially horizontal, and
- in a transport configuration, in which the mast 2 and the jib 4 are folded, and in which the jib direction X4 is parallel to the mast direction Z2.

When the tower crane 1 is in the operation configuration (FIGS. 1 and 2) on a horizontal ground, the mast direction Z2 can form an angle comprised between 0 degrees and 3 degrees with a vertical direction. When the tower crane 1 is in the operation configuration (FIGS. 1 and 2), the jib direction X4 can form an angle comprised between 0 degrees and 45 degrees with a horizontal direction. Between the operation (FIGS. 1 and 2) and transport (FIG. 3) configurations, the mast 2 and the jib 4 pass through intermediate positions which are not represented.

As shown in FIG. 1, the mast 2 has a first mast section 2.1 and a second mast section 2.2. The first mast section 2.1 and the second mast section 2.2 extend substantially along the mast direction Z2 when the tower crane 1 is in the operation configuration.

The first mast section 2.1 has a polygonal shaped cross-section with eight sides. The second mast section 2.2 has a polygonal shaped cross-section with eight sides. The first mast section 2.1 has a generally prismatic shape composed of flat metal sheets. The second mast section 2.2 has a generally prismatic shape composed of flat metal sheets.

The first mast section 2.1 and the second mast section 2.2 are configured so that the first mast section 2.1 can slide inside the second mast section 2.2, during the telescoping phases in order to unfold and fold the tower crane 1.

Hence, the mast 2 herein comprises a telescopic portion, composed of the first 2.1 and second 2.2 mast sections. In the operation configuration (FIGS. 1 and 2), the first mast section 2.1 extends above the second mast section 2.2. In the transport configuration (FIG. 3), when the tower crane 1 is stowed in a container 50, the first mast section 2.1 extends in the second mast section 2.2.

The jib 4 has a first jib section 4.1, a second jib section 4.2 and a third jib section 4.3. The first job section 4.1, the second jib section 4.2 and the third jib section 4.3 extend substantially along the jib direction X4 when the tower crane 1 is in the operation configuration.

The first mast section 2.1 is rotatably connected to the first jib section 4.1 about a hinge axis Y24. The hinge axis Y24 extends orthogonally to the mast direction Z2 and to the jib direction X4 when the tower crane 1 is in the operation configuration and when the tower crane 1 is in the transport configuration.

Figure 6:
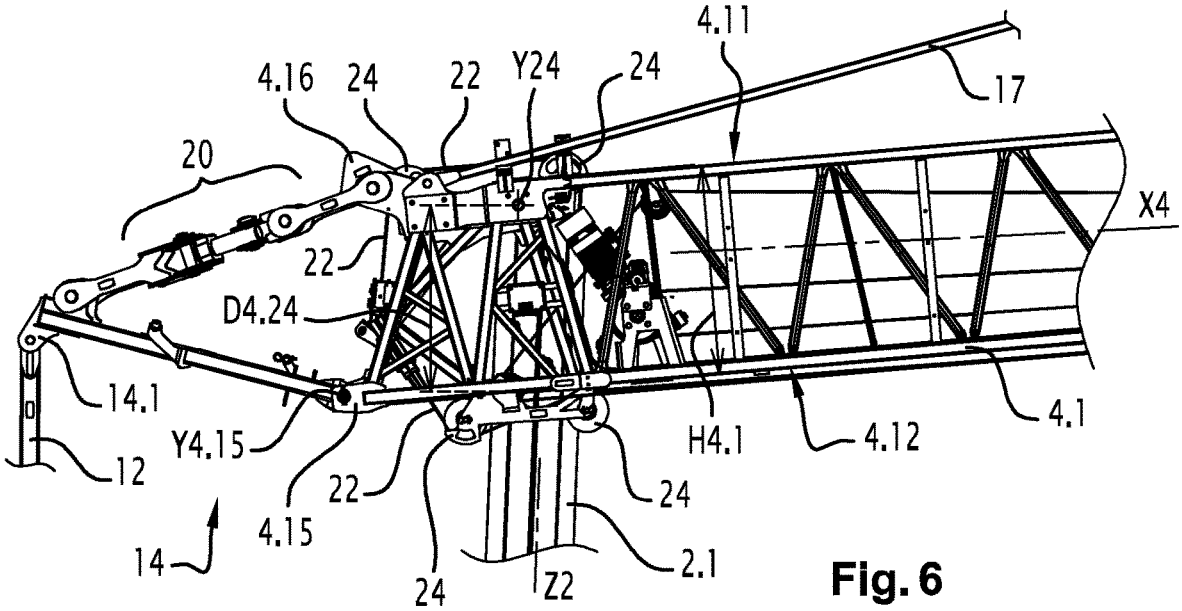
FIG. 6 is a side view according to the arrow VI in FIG. 5.

As shown in FIGS. 5 and 6, at the level of the mast 2, the first jib section 4.1 has an upper limit 4.11 and a lower limit 4.12. The upper limit 4.11 and the lower limit 4.12 define a height H4.1 of the first jib section 4.1.

The height H4.1 is measured orthogonally to the jib direction X4 when the tower crane 1 is in the operation configuration. The height H4.1 of the first jib section 4.1 is greater than the width W4.1 of the first jib section 4.1, measured parallel to the hinge axis Y24. The cross-section of the jib 4 herein is trapezoidal.

The height H4.1 of the first jib section 4.1 herein is approximately equal to 1000 mm. The height H4.1 of the first jib section 4.1 is greater than the height of the second jib section 4.2 and the height of the third jib section 4.3.

In the example of FIGS. 1 to 8, the first jib section 4.1 comprises i) two upper chords defining the upper limit 4.11 and ii) two lower chords defining the lower limit 4.12. Each upper chord and each lower chord has a generally prismatic shape. The two upper chords and the two lower chords of the first jib section 4.1 are arranged so that the first jib section 4.1 has a trapezoidal section transversely to the jib direction X4.

The tower crane 1 further comprises a hinge device 3 which is configured to rotatably connect the first mast section 2.1 and the first jib section 4.1. The hinge device 3 comprises rotary bearings. The hinge device 3 is sized in stresses and in deformations, so as to mechanically resist the moments generated on the mast 2 by the position of the jib 4 in operation.

The first jib section 4.1 comprises a jib hinge portion 4.5. The first mast section 2.1 comprises a mast hinge portion 2.5. The hinge device 3 mechanically connects the jib hinge portion 4.5 and the mast hinge portion 2.5.

The mast hinge portion 2.5 is located close to the upper limit 2.11 of the mast 2 when the tower crane 1 is in the operation configuration (FIGS. 1 and 2). The distance between the mast hinge portion 2.5 and the upper limit of the mast 2.11 herein is smaller than 5% of the height H2.1 of the first mast section 2.1, measured parallel to the mast direction Z2 when the tower crane 1 is in the operation configuration.

The jib hinge portion 4.5 is located close to the rear end of the jib 4 when the tower crane 1 is in the operation configuration. The distance between the jib hinge portion 4.5 and the rear end of the jib 4 is smaller than 20% of the length of the first jib section 4.1, measured parallel to the jib direction X4 when the tower crane 1 is in the operation configuration.

Figure 7:
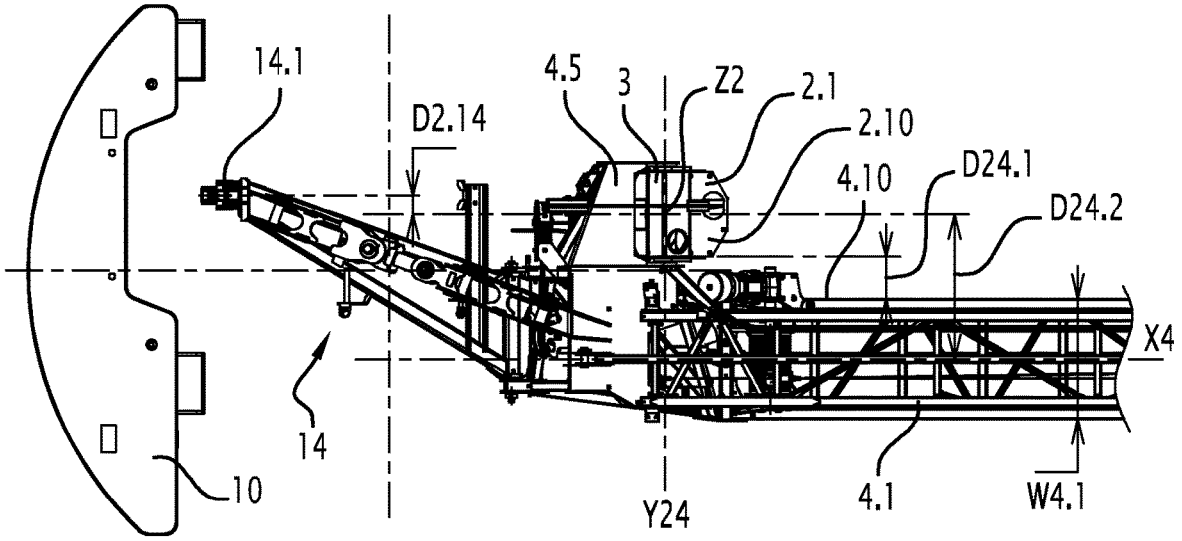
FIG. 7 is a top view of a rear portion of the tower crane of FIG. 1.
Figure 8:
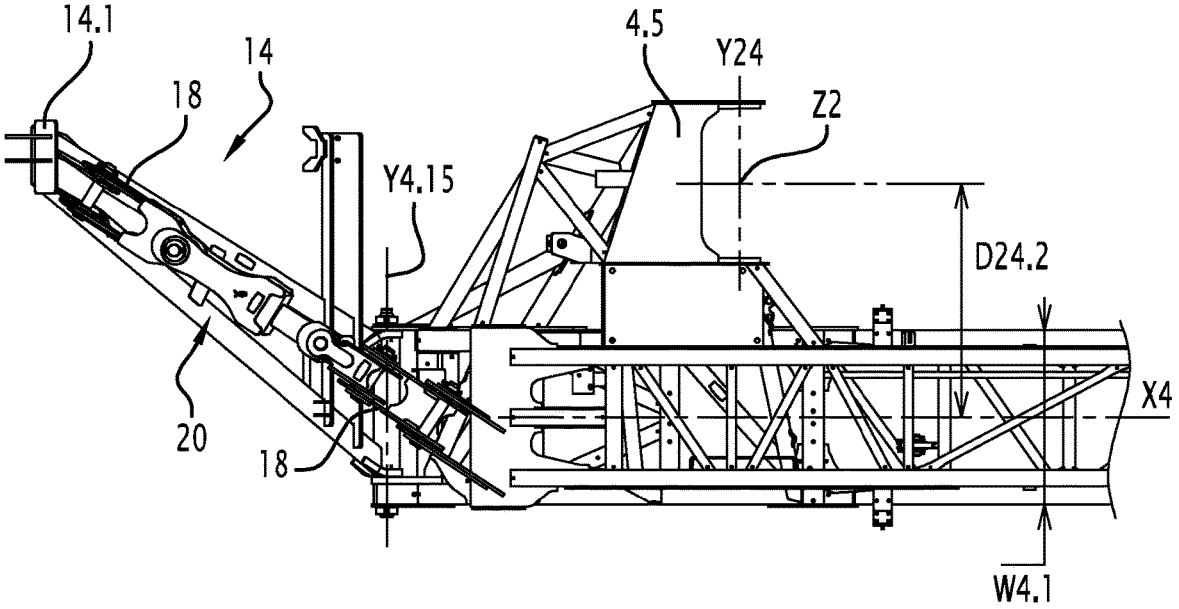
FIG. 8 is a top view of a rear portion of the jib of FIG. 1.
Figure 9:
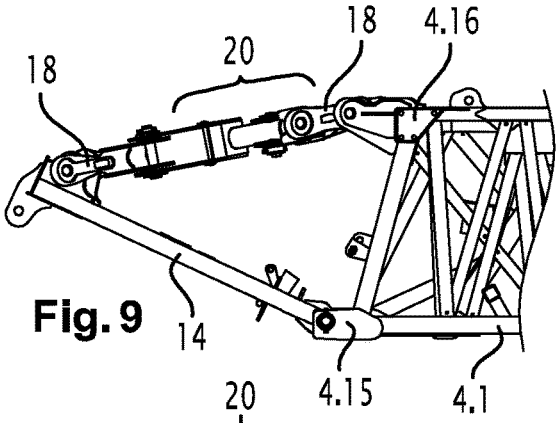
FIG. 9 is a side view of a rear portion, with an unfolded king-rod, of the jib of FIG. 1.
Figure 10:
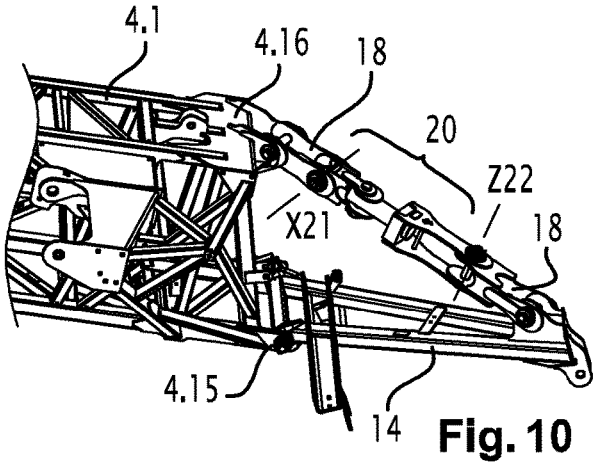
FIG. 10 is a perspective view of the rear portion of FIG. 9.
Figure 11:
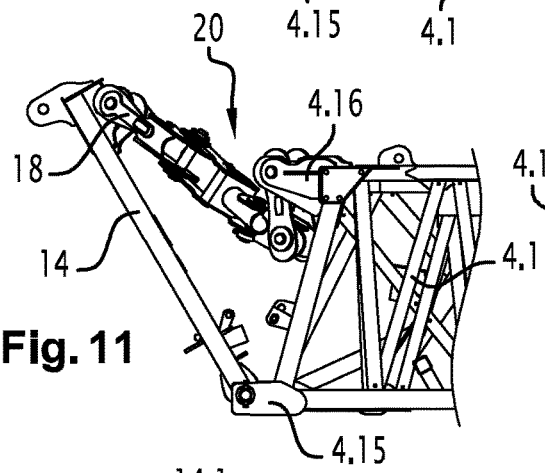
FIG. 11 is a side view of the rear portion of FIG. 9, with the king-rod being folded.
Figure 12:
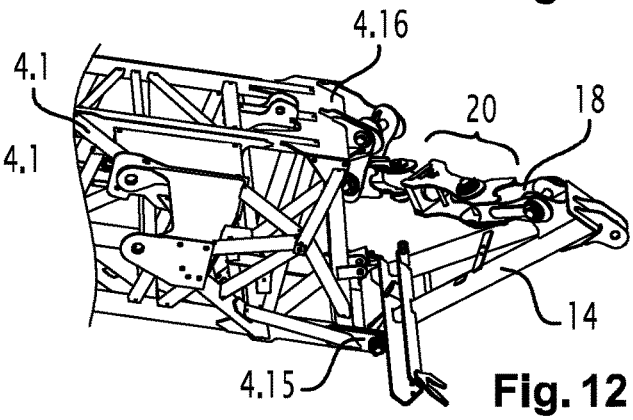
FIG. 12 is a perspective view of the rear portion of FIG. 11.

As shown in FIGS. 7 and 8, the jib direction X4 is shifted with respect to the mast direction Z2 parallel to the hinge axis Y24. The jib direction X4 and the mast direction Z2 are separate, and therefore non-intersecting, directions. As shown in FIG. 7, when the tower crane 1 is in the operation configuration (FIGS. 1 and 2), a lateral portion 4.10 of the first jib section 4.1 extends along a lateral portion 2.10 of the first mast section 2.1.

In this case, the jib direction X4 is shifted with respect to the mast direction Z2 so that a shift distance D24.1 between i) the lateral portion 4.10 turned toward the mast 2 and ii) the lateral portion 2.10 turned toward the jib 4, measured parallel to the hinge axis Y24, is approximately equal to 250 mm. A shift distance D24.2 between the jib direction X4 and the mast direction Z2, measured parallel to the hinge axis Y24, herein is approximately equal to 900 mm.

Moreover, a distance D4.24 between the hinge axis Y24 and the lower limit 4.12, measured parallel to the mast direction Z2 as shown in FIG. 6, herein is approximately equal to 90% of said height H4.1 of the first jib section 4.1. Hence, the hinge axis Y24 extends in an upper region 4.16 of the first jib section 4.1.

As shown in FIG. 5, the tower crane 1 further comprises a hoisting cable 22 and several pulleys 24 configured to guide the hoisting cable 22 between the first mast section 2.1 and the first jib section 4.1.

The axes of the pulleys 24 are not parallel. The pulleys 24 are arranged so that two consecutive pulleys 24 along the hoisting cable 22 have two tangential directions which are collinear. Hence, the tracks of two consecutive pulleys are aligned, which gives the hoisting cable 22 a high resistance to wear and to fatigue, because the pulley tracks are aligned in pairs.

Moreover, the tower crane 1 further comprises a frame 8, a retaining tie-rod 12 and a force transmitting member which is arranged to transmit forces from the jib 4 to the retaining tie-rod 12 and which herein is formed by a king-rod 14.

The frame 8 is configured to support the mast 2 and the jib 4 when the tower crane 1 is in the operation configuration. The frame 8 receives a counterweight 10 when the tower crane 1 is in the operation configuration. The frame 8 herein is composed of a rotating portion 8.1, a fixed portion 8.2 and a slewing ring 8.3 which hinges the rotating portion 8.1 relative to the fixed portion 8.2.

The retaining tie-rod 12 connects the rear end of the jib 4 to the rear end of the rotating portion 8.1. The retaining tie-rod 12 extends substantially parallel to the mast 2 when the tower crane 1 is in the operation configuration. The retaining tie-rod 12 herein is composed of several hinged bars some of which are telescopic.

The force transmitting member is constituted only by the king-rod 14. As shown in FIGS. 7 and 8, the king-rod 14 extends obliquely with respect to the jib direction X4. The king-rod 14 comprises a guide element 14.1 configured to guide the retaining tie-rod 12 at the rear end of the jib 4. The jib 4 is devoid of a vertical king-rod above the jib 4 for supporting the first jib section 4.1, which simplifies the mounting of the tower crane.

The guide element 14.1 is located on the side opposite to the jib direction X4 with respect to the mast direction Z2. Hence, the guide element 14.1 and the jib direction X4 are located on either side of the mast direction Z2. A distance D2.14 between the guide element 14.1 of the king-rod 14 and the mast direction Z2 herein is approximately equal to 120 mm, measured parallel to the hinge axis Y24.

In addition, the tower crane 1 comprises an intermediate king-rod 17, which is partially visible in FIGS. 5 and 6. The intermediate king-rod 17 is arranged above the junction between the first 2.1 and second 2.2 jib sections.

The tower crane 1 further comprises an unfolding cylinder 16 configured to unfold the mast 2, in order to place the mast 2 in the operation configuration. The jib 4 is set in the operation configuration by the telescoping of the mast 4. The unfolding cylinder 16 is arranged on the same side of the mast direction Z2 as the first jib section 4.1.

Figure 16:
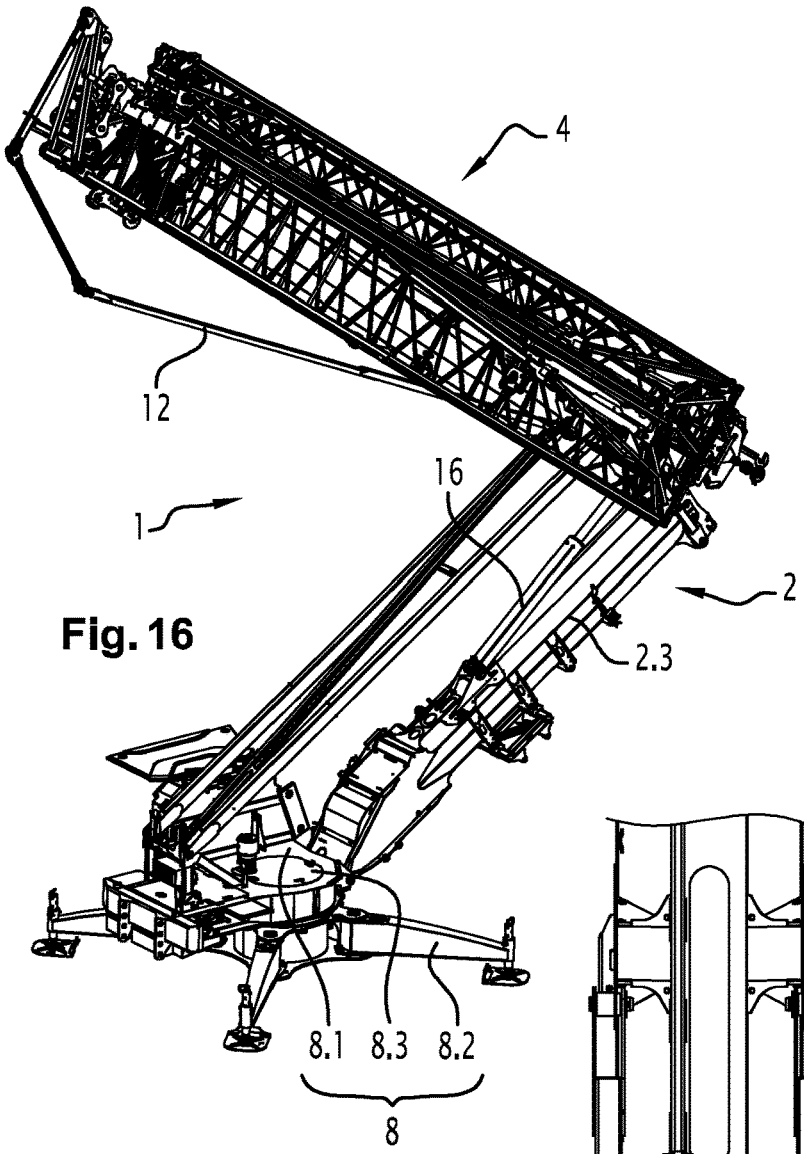
FIG. 16 is a perspective view of the tower crane of FIG. 1, during unfolding.
Figure 17:
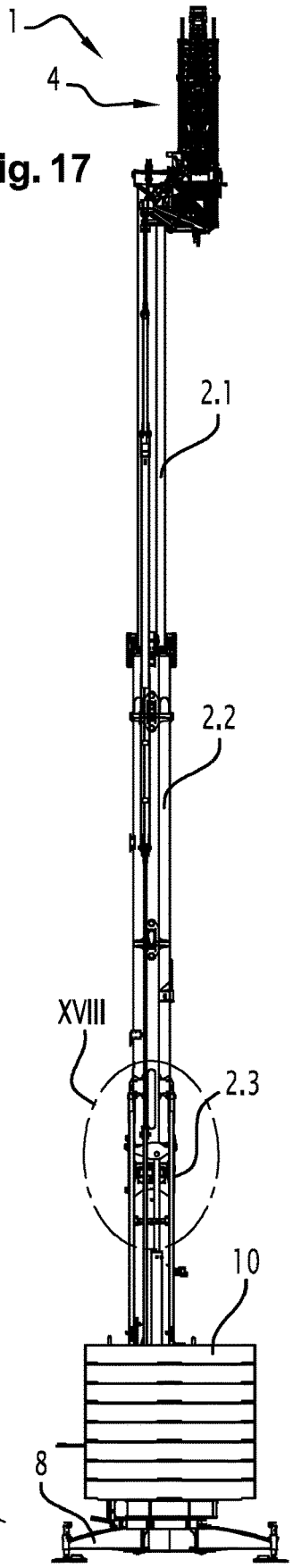
FIG. 17 is a front view of the tower crane of FIG. 1 in the operation configuration.
Figure 18:
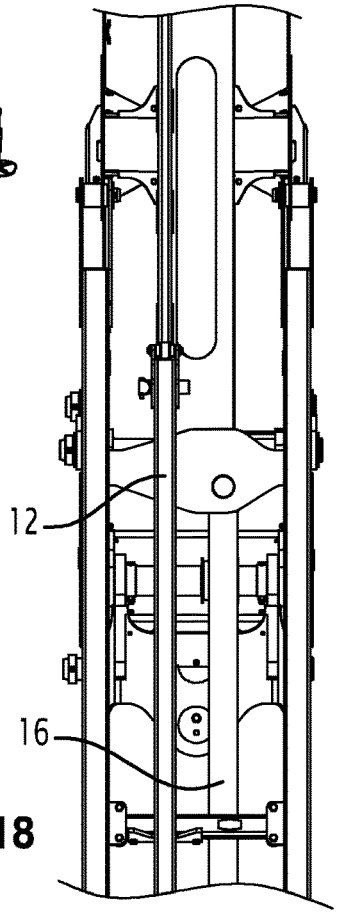
FIG. 18 is a larger scale view of the detail XVIII in FIG. 17.

As shown in FIGS. 16, 17 and 18, the retaining tie-rod 12 extends substantially on the side opposite to the jib direction X4 with respect to the mast direction Z2. Hence, the retaining tie-rod 12 and the unfolding cylinder 16 extend on either side of the mast direction Z2. Thus, the retaining tie-rod 12 can limit the lateral cantilever effect of the jib 4 on the mast 2 in the operation configuration and the unfolding cylinder 16 is located on the side of the jib 4, and therefore close to the overall center of gravity of the masses to be lifted.

Figure 13:
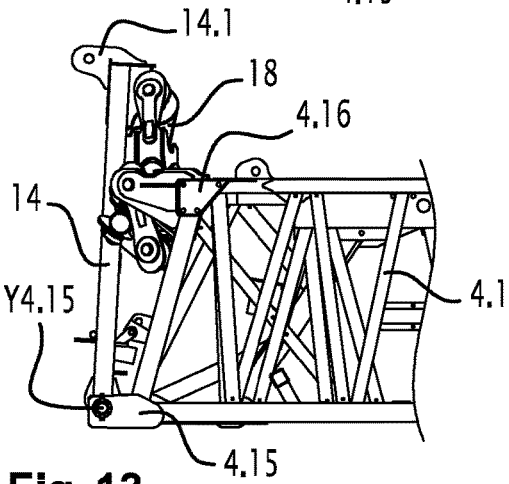
FIG. 13 is a side view of the rear portion of FIG. 9, with the king-rod folded.
Figure 14:
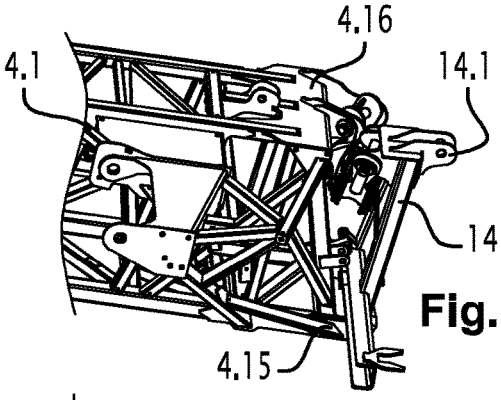
FIG. 14 is a perspective view of the rear portion of FIG. 13.
Figure 15:
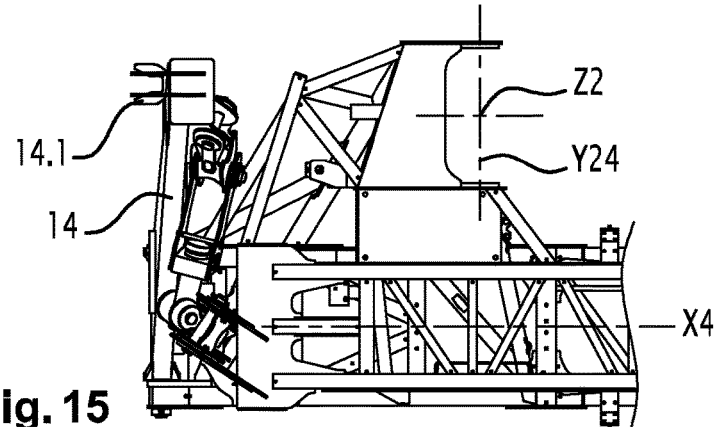
FIG. 15 is a top view of the rear portion of FIG. 13.

As shown in particular in FIGS. 6, 8 and 13, the king-rod 14 and a lower portion 4.15 of the first jib section 4.1 are rotatably linked about an axis of rotation Y4.15. The axis of rotation Y4.15 herein is parallel to the hinge axis Y24.

The tower crane 1 further comprises connecting rods 18 and a universal joint 20 which is arranged to connect the king-rod 14 to an upper portion 4.16 of the first jib section 4.1. The connecting rods 18 are hinged together by pivot linkages and by the universal joint 20. When the tower crane 1 is in the unfolding or folding phase, the connecting rods 18 and the universal joint 20 allow unfolding or folding the king-rod 14 from or toward a stowed position.

In the stowed position, the king-rod 14 extends both opposite the first jib section 4.1 and opposite the first mast section 2.1. The universal joint 20 and the axis of rotation Y4.15 allow folding the king-rod 14 when the mast 2 and the jib 4 are folded in the transport configuration.

As shown in FIGS. 5 to 15, the universal joint 20 includes several separate pivot axes, among which two orthogonal pivot axes X21 and Z22, visible in FIG. 5.

As shown in FIGS. 4, 16 and 18, the mast 2 has a third mast section 2.3 arranged to mechanically connect the second mast section 2.2 to the frame 8. The third mast section 2.3 herein has an octagonal cross-section which has a generally prismatic shape and which is composed of flat metal sheets.

As shown in FIG. 3, when the tower crane 1 is in the transport configuration in a container 50, the first 4.1, the second 4.2 and the third 4.3 jib sections are superimposed and disposed next to the mast 2, which makes the transport configuration particularly compact. In particular, the second 4.2 and third 4.3 jib sections are nested, and then superimposed to the first jib section 4.1.

The first 4.1, the second 4.2 and the third 4.3 jib sections may be superimposed, in particular because the jib 4 is shifted or offset laterally with respect to the mast 2 and because the hinge axis Y24 is placed on top of the first jib section 4.1.

As shown in FIG. 4, when the tower crane 1 is in the transport configuration, the first mast section 2.1 is inserted in the second mast section 2.2, and the first 2.1 and second 2.2 mast sections are superimposed to the third mast section 2.3.

Of course, the present invention is not limited to the particular embodiments described in the present patent application, nor to embodiments within the reach of those skilled in the art. Other embodiments may be considered without departing from the scope of the invention, starting from any element equivalent to an element indicated in the present patent application.

The invention claimed is:

1. An automatic unfolding and folding tower crane, comprising a mast and a jib configured to be placed at least:

in an operation configuration, in which the mast extends along a mast direction which is substantially vertical, and the jib extends along a jib direction which is substantially horizontal, and in a transport configuration in which the mast and the jib are folded, the mast having at least: one first mast section and one second mast section which extend substantially along the mast direction when the automatic unfolding and folding tower crane is in the operation configuration, the jib having at least: one first jib section and one second jib section which extend substantially along the jib direction when the automatic unfolding and folding tower crane is in the operation configuration, the first jib section having, at the level of the mast, an upper limit and a lower limit, the upper limit and the lower limit defining a height of the first jib section, the first mast section being connected to the first jib section at least in rotation about a hinge axis, the hinge axis extending orthogonally to the mast direction and to the jib direction when the automatic unfolding and folding tower crane is in the operation configuration, wherein:

the jib direction is shifted with respect to the mast direction parallel to the hinge axis, a distance between the hinge axis and the lower limit, measured parallel to the mast direction, is greater than 75% of said height of the first jib section.

2. The automatic unfolding and folding tower crane according to claim 1, wherein the distance between the hinge axis and the lower limit, measured parallel to the mast direction, is greater than 90% of the height of the first jib section.

3. The automatic unfolding and folding tower crane according to claim 1, wherein the first jib section comprises at least: i) one upper chord defining the upper limit and ii) one lower chord defining the lower limit.

4. The automatic unfolding and folding tower crane according to claim 1, wherein the jib direction is shifted with respect to the mast direction so that a shift distance between i) a lateral portion of the jib turned toward the mast and ii) a lateral portion of the mast turned toward the jib, measured parallel to the hinge axis, is greater than 200 mm, preferably greater than 250 mm.

5. The automatic unfolding and folding tower crane according to claim 4, wherein the shift distance between i) the lateral portion of the jib turned toward the mast and ii) the lateral portion of the mast turned toward the jib, measured parallel to the hinge axis, is greater than 250 mm.

6. The automatic unfolding and folding tower crane according to claim 1, wherein the first mast section and the second mast section are configured so that the first mast section may slide inside the second mast section.

7. The automatic unfolding and folding tower crane according claim 1, wherein said height of the first jib section is greater than a width of the first jib section, measured parallel to the hinge axis.

8. The automatic unfolding and folding tower crane according to claim 1, further comprising:

a frame configured to support the mast and the jib when the tower crane is in the operation configuration, the frame being intended to receive a counterweight, a retaining tie-rod arranged to connect the rear end of the jib to the counterweight, the retaining tie-rod being configured to extend substantially parallel to the mast when the tower crane is in the operation configuration, and a force transmitting member arranged to transmit forces from the jib to the retaining tie-rod, the transmission member being constituted by a king-rod extending obliquely with respect to the jib direction.

9. The automatic unfolding and folding tower crane according to claim 8, wherein the king-rod comprises a guide element which is configured to guide the retaining tie-rod, the guide element being located on the side opposite to the jib direction with respect to the mast direction.

10. The automatic unfolding and folding tower crane according to claim 9, wherein a distance between the guide element of the king-rod and the mast direction, measured parallel to the hinge axis, is comprised between 75 mm and 150 mm.

11. The automatic unfolding and folding tower crane according to claim 8, wherein the retaining tie-rod extends substantially on the side opposite to the jib direction with respect to the mast direction, the tower crane further comprising an unfolding cylinder configured to unfold the mast, in order to place the mast and the jib in the operation configuration, the unfolding cylinder being arranged on the same side of the mast direction as the first jib section.

12. The automatic unfolding and folding tower crane according to claim 8, wherein the king-rod and a lower portion of the first jib section are rotatably linked about an axis of rotation which is parallel to the hinge axis, the tower crane further comprising connecting rods and a universal joint arranged to connect the king-rod to an upper portion of the first jib section, the connecting rods being hinged together by pivot linkages and by the universal joint.

13. The automatic unfolding and folding tower crane according to claim 1, further comprising a hoisting cable and several pulleys configured to guide the hoisting cable between the first mast section and the first jib section, the axes of the pulleys being non-parallel, the pulleys being arranged so that two consecutive pulleys along the hoisting cable have two collinear tangential directions.

14. The automatic unfolding and folding tower crane according to claim 1, wherein, when the tower crane is in the transport configuration, the first and the second jib sections are superimposed and disposed next to the mast.

* * * * *